United States Patent [19]

Alexander

[11] 4,123,937

[45] Nov. 7, 1978

[54] METHODS OF DETERMINING WELL CHARACTERISTICS

[76] Inventor: Lloyd G. Alexander, 1314 Klondyke Ave. SW., Calgary, Alberta, Canada

[21] Appl. No.: 837,229

[22] Filed: Sep. 27, 1977

Related U.S. Application Data

[63] Continuation-in-part of Ser. No. 801,743, May 31, 1977, abandoned.

[51] Int. Cl.[2] ..... E21B 47/06

[52] U.S. Cl. ..... 73/155

[58] Field of Search ..... 73/37, 38, 149, 151, 73/155, 391; 166/250

[56] References Cited

U.S. PATENT DOCUMENTS

| | | | |
|---|---|---|---|
| 2,792,708 | 5/1957 | Johnson, Jr. et al. | 73/151 X |
| 2,792,709 | 5/1957 | Bell et al. | 73/155 |
| 3,321,965 | 5/1967 | Johnson et al. | 73/155 |
| 3,489,002 | 1/1970 | Thompson | 73/149 |

*Primary Examiner*—Jerry W. Myracle

*Attorney, Agent, or Firm*—Roylance, Abrams, Berdo & Farley

[57] ABSTRACT

A method of determining the volume of gas in a well below the wellhead includes measuring the gas flow rate in the well annulus, closing the wellhead and measuring the change in pressure with time, and calculating the volume from the recorded data. A further method includes determining the change of pressure with time with the wellhead closed, venting the well through a calibrated orifice and measuring pressure changes with time for a short interval of time, and calculating from the recorded data the flow rate through the orifice, the annuluar gas volume and the annular gas rate. Pump rates and fluid rates can also be determined. A reverse technique using injection is also disclosed.

15 Claims, 4 Drawing Figures

METHODS OF DETERMINING WELL CHARACTERISTICS

This application is a continuation-in-part of U. S. pat. application Ser. No. 801,743, filed May 31, 1977, now abandoned.

This invention relates to methods for determining characteristics in a pumping well including the "gas-free" fluid level, the annular gas flow rate, the bottom-hole pressure, and the efficiency of the pumping system.

BACKGROUND OF THE INVENTION

Determination of flow rates, static bottom hole pressure and other characteristics of a pumping well has been the subject of considerable interest and study. A background discussion of this topic appears in the document entitled, "Guide for Calculating Static Bottom-Hole Pressure Using Fluid Level Recording Devices", published by the Energy Resources Conservation Board, and in references cited therein. Reference is also made to the following U.S. Patents which discuss determinations of various characteristics, particularly in a pumping well, which are related: Reissue Patent, U.S. Pat. Re. No. 21,383, Walker; U.S. Pat. No. 2,320,492, Walker; U.S. Pat. No. 3,877,301, Jensen, Jr.; and U.S. Pat. No. 3,895,527, McArthur.

These references, particularly the Walker patents, include interesting and informative background material on the stages of well production and some of the problems associated therewith.

Knowledge of the dynamic and static bottom-hole pressures in a pumping well enables the operator to determine the optimal surface and lifting facilities for present and future operations. The bottom hole pressure under flowing conditions is usually obtained by first determining the fluid level with an acoustic device. The height of the liquid column is calculated and an assumed pressure gradient for the fluid is then applied to the liquid column to arrive at the dynamic bottom hole pressure. Whenever there is doubt about the fluid level or the pressure gradient, the operator often closes the annulus in order to lower the level of the liquid to the pump seating nipple. The pressure can then be determined accurately, because a kmown gas pressure gradient exists from the surface to the pump seating nipple.

However, the prssure data so obtained may not agree with those which existed at the flow rate prior to the closure of the annulus valve. Therefore, a new stabilized flow rate, which corresponds to the altered pressure, must be allowed to establish itself. This procedure is time consuming and may lead to a loss of production because flow of free gas through the pump reduces the pumping efficiency.

BRIEF SUMMARY OF THE INVENTION

An object of the present invention is to provide methods of determining the gas-free liquid level and the annular flow rate of gas without a significant change in the bottom hole pressure.

A further object is to provide a method of using the foregoing information to permit calculation of the bottom hole pressure under flowing conditions using a pressure gradient of the liquid which is consistent with its pressures and temperature.

Briefly described, one aspect of the invention includes a method of determining the volume of gas in a well annulus below the wellhead comprising the steps of measuring the rate of gas flow in the annulus while a path for emerging gas is open through the wellhead; closing the well-head gas path and measuring the change of pressure in the annulus over a predetermined interval of time to determine the pressure change rate, and, calculating the volume of gas as a function of the ratio of said gas flow measurement to said pressure change rate.

Another aspect of the invention comprises a method of determining the volume of gas in a well annulus below the wellhead comprising the steps of providing on said wellhead a vent plate having a vent orifice a predetermined calibrated size and a valve to selectively open and close the gas path between the well and the vent plate; closing said valve and measuring and recording the change in pressure at the wellhead and the interval of time over which said change took place; opening said valve to permit venting through said orifice to the atmosphere for a predetermined interval of time; measuring and recording gas pressure at the welhead and the times of said measurements during said interval; and calculating from said recorded measurement the gas flow rate through said orifice, the gas volume V in said annulus and the annular gas rate.

Another aspect of the invention comprises a method of determining the volume of gas in a well below the wellhead comprising the steps of providing on said wellhead a metering device and a valve to selectively open and close the gas path between the well and the metering device; closing said valve and measuring and recording the change in pressure at the wellhead and the interval of time over which said change took place; connecting a source of gas under pressure to said metering device; opening said valve to permit injection of said gas through said metering device to the well annulus for a predetermined interval of time; repeatedly measuring and recording gas pressure at the wellhead and the times of said measurements during said interval; and calculating from said recorded measurements the gas flow rate through said metering device, and the gas volume V.

In order that the manner in which the various objects of the invention are attained can be understood in detail, particularly advantageous embodiments thereof will be described with reference to the accompaying drawings, which form a part of this specification and wherein.

DETAILED DESCRIPTION

Figure 1:
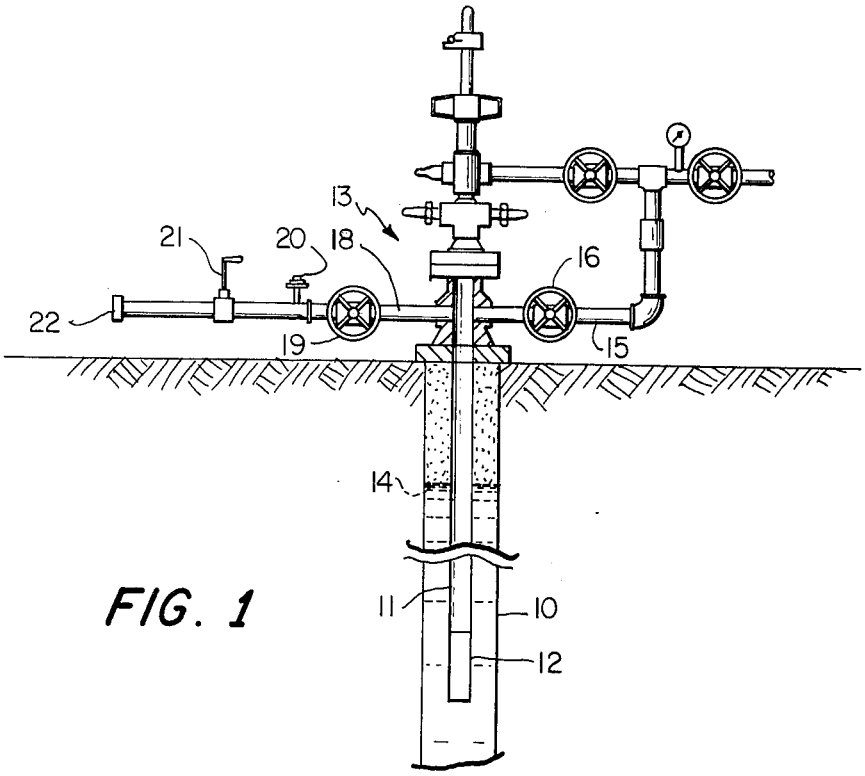
FIG. 1 is a simplified schematic elevational view of a well and a wellhead with which the method of the present invention can be used.

The methods of the present invention will be described with reference to FIG. 1 which shows in somewhat simplified form the production equipment at the top of a well. The well itself comprises a generally cylindrical bore, usually cased, into which production casing 10 and a small tubing string 11 extend, the tubing having a pump mechanism 12 at the lower end thereof. The tubing can normally be raised or lowered to dispose the pump at an appropriate location, and suitable control devices, not shown, extend down the well to control the operation of the pump which drives liquid up through the tubing to the surface of the earth.

At the top of the well, the opening is closed by the usual wellhead apparatus, sometimes referred as a "Christmas tree", indicated generaly at 13. The tubing extends into a portion of this apparatus including valves and pipes for conveying the gas and liquid away from the location. As will be recognized, the tubing and casing define an annular cavity which generally includes gas and oil, the interface between these being indicated at 14. The level at which this interface exists is a function of several variables, including the production rate, the formation pressure, the back pressure of the gas itself, and the viscosity and density of the liquid and gas involved. The annular cavity within the well is connected to an annular portion of the wellhead pipe and valve mechanism at the top, and gas is normally extrated, as through a conduit 15, for separate use and sale. Flow therethrough is controlled by a valve indicated at 16.

The annular chamber which contains the gas can also be connected to a separate conduit 18, flow through conduit 18 being controlled by a valve 19. The conduit can also be provided with pressure gauge devices such as a deadweight gauge indicated at 20, or other suitable pressure measuring device; an auxiliary shutoff valve 21 on the outlet side of the gauge and a critical flow prover 22 which is used in the method of the present invention. A flow prover is, basically, a plate having an orifice of a predetermined calibrated size which permits venting of gas to the atmosphere or injection of gas into the well at a determinable flow rate.

The volume of gas in the annulus can be considered as being contained in a vertical cylinder, the volume of which can vary depending upon the level of largely gas-free liquid in the annulus, the upper surface of which is indicated at interface 14, this interface defining the base of the gas-containing cylinder. Under normal operating conditions, gas is vented at the same rate as it enters, as through conduit 15, and no change of the mass of the gas contained in this cylindrical portion at the upper end of the well occurs. The gas enters this upper portion of the well by bubbling upwardly through the liquid, the rate of entry being a function of the characteristics of the formation being produced. If, however, the flow rate of gas being vented differs from the input flow rate, then the mass of the system will change. For single-phase gas flow, the mass change is represented by the following relationship:

$$d(\text{mass system})/dt = (\text{mass rate in} - \text{mass rate out}) \quad (1)$$

The separate terms in this relationship are defined as follows:

mass in system $= p\mathrm{MV/RTz}$
mass rate in $= p_{sc}\mathrm{Mq_1/RT}_{sc}$
mass rate out $= p_{sc}\mathrm{Mq_2/RT}_{sc}$ Substituting these expressions in equation (1), the mass balance equation becomes $$d(pMV/RTz)/dt = p_{sc}M(q_1 - q_2)/RT_{sc}$$

where $p$ = Pressure, psia
$M$ = molecular weight of gas
$V$ = gas volume, barrels (bbls), or cubic feet in equations (1) and (2)
$R$ = gas constant
$T$ = temperature of gas, °R
$z$ = gas deviation factor
$p_{sc}$ = pressure, standard conditions
$q_1$ = flow rate up the annulus, thousands of standard cubic fee per day (Mscf/D)
$q_2$ = flow rate through prover (Mscf/D)
$T_{sc}$ = temperature, °R, standard condition If it is assumed that Tz is a constant, then the above can be written as $$q_1 - q_2 = T_{sc}(Vdp/dt + pdv/dt)/p_{sc}Tz \quad (2)$$

For a standard temperature of 60° F., and a pressure base of 14.65 psia, equation (2) reduces to $$q_1 - q_2 = 286(Vdp/dt + pdV/dt)Tx \quad (3)$$

The constant 286 results from converting from cubic feet per day into barrels per minute. For a constant bottom-hole pressure, the change in the liquid volume $dV$ related to the change in tophole pressure is as follows:

$$dv = c \times \text{pressure change } dp(\text{psi})$$

$$dv = \text{liquid gradient (ft./psi)} \times \text{annular capacity (bbls/ft.)} \times \text{pressure change } dp \text{ (psi)}.$$

Thus, equation (3) can be rewritten as follows for constant bottom-hole pressure;

$$q_1 - q_2 = (286(V + pC)dp/dt)Tz \quad (4)$$

wherein C is the product of the liquid gradient and the annular capacity.

For a constant liquid level, $dV/dt$ is zero, in which case equation (3) becomes:

$$q_1 - q_2 = 286\mathrm{V}dp/dt)/Tz \quad (5)$$

Field data obtained show that the liquid level remains constant during the short period of testing, provided that the change of surface pressure is not more than 5 psi. In such cases, it is reasonable to assume that equation (5) is valid for practical purposes. Two situations will be considered for the determination of the free gas volume, and hence the liquid level, using direct and indirect measurements of gas flow rates.

The first case involves the direct measurement of $q_1$, for which case the valve 21 leading to the flow prover will be assumed closed. Under these conditions, $q_2$ is substantially equal to zero and C equals zero. Thus, from equation (3) or (4), $$q_1 = (286\ V(dp/dt)_1)/Tz \quad (6)$$

DIRECT METHOD

The direct method is relatively simple single-step procedure, based on equation (6) to determine the volume of gas in the annulus. If the annular gas flow rate $q_1$ is measured directly and the annulus is then closed to cause a pressure build-up, the volume of gas in the annulus, inclusive of the gas bubbles in the fluid column below the gas-liquid interface, can be determined directly. The depth of the "gas-free" fluid level follows from the division of the gas volume by the annular capacity. It should be recognized that the term "gas-free fluid level" refers to the level which would exist if all gas entrained in the liquid were in the volume above the interface. This level will therefore differ from an acoustically measured level, or distance down to the interface. Knowing this fluid level, the bottom-hole pressure can be calculated using a pressure gradient for the liquid which is consistent with the existing pressure and temperature of the oil column. Details of this procedure are described in the above-identified Energy Resources Conservation Board Report No. 74-S, which is hereby incorporated by reference.

More specifically, if valve 16 is opened to permit free egress of the gas, it is possible to measure the annulus gas flow rate $q_1$ directly. Then, with valve 16 closed, valve 21 closed and valve 19 open, the pressure can be measured using gauge 20. Several pressure measurements are made at spaced time intervals and the measurements are recorded along with the time (measured from the start of the test) at which those pressure measurements were made.

By plotting the pressure and time measurements graphically, and determining the slope of a line passing through the plotted points, the factor $dp/dt$ can be determined. Gas temperature T and deviation factor $z$ are readily determinable. Thus, everything in equation (6) is known except V which can then be calculated.

INDIRECT METHOD

Direct measurements of the annular flow rate is usually impractical due to the configuration of the wellhead. However, indirect measurement of the annular flow rate can be employed, using the following procedure.

The first step involves the use of the critical flow prover 22 on the off-side master valve, as illustrated in FIG. 1. For most wells, a flow prover having a 1/16 inch orifice plate is adequate. The annulus pressure is checked by means of a dead-weight gauge, as illustrated, or some other suitable pressure measuring device with valve 21 closed and valves 16 and 19 open. The on-side casing valve 16 is then closed and the pressure build-up is recorded over an interval of a number of minutes or until a pressure build-up of 5 psi is reached. A typical interval is about ten minutes if the pressure build-up does not exceed this level.

The second step is to vent conduit 18 on the off-side through the critical flow prover to the atmosphere by opening valve 21 to allow a small and essentially constant flow of gas from the annulus. During the flow period, pressures and time are recorded to establish a second build-up or draw down, as the case may be. After the flow period, valves 19 and 21 can be closed and the critical flow prover can be removed and the well returned to normal operating conditions.

In the indirect measurement method, the flow rates $q_1$ and $q_2$ are not equal to zero, but C is approximately equal to zero.

Thus, $$q_1 - q_2 = 286\ V(dp/dt)_2/Tz \tag{7}$$

and $$q_2 = q_1 - 286\ V(dp/dt)_2Tz$$

Substituting the expression for $q_1$ as determined in the method given above, (equation (6)), $$q_2 = 286\ V(dp/dt)_1/Tz - 286\ V(dp/dt)_2/Tz = 286\ V((dp/dt)_1 - (dp/dt)_2)/Tz$$

Thus, $V$, the volume of free gas, is given by $$V = q_2Tz/(286((dp/dt)_1 - (dp/dt)_2)) \tag{8}$$

and the flow $q_2$ through the critical flow prover is given by $$q_2 - pF\sqrt{(520/GTz)} \tag{9}$$

wherein F is the choke constant for the flow prover.

After solving equation (8) for the free-gas volume V, the annular flow rate of gas $q_1$ follows from equation (6). The bottom-hole pressure is calculated in the same manner as described for the direct method, in accordance with report 74-S.

The following examples will serve to illustrate the application of the foregoing method.

EXAMPLE 1

Well No. 1, equipped with a 5½ inch production and a 2⅞ inch tubing string was tested by the indirect method. A critical flow prover was installed on the off-side casing valve and a pressure of 187.0 psig (dead-weight) was noted. The on-side valve 16 was then closed and the following pressure build-up occurred:

TABLE 1

| PRESSURE (psig) | TIME (min.-sec.) |
|---|---|
| 187.0 | 0 - 0 |
| 188.0 | 0 - 50 |
| 189.0 | 1 - 43 |
| 190.0 | 2 - 38 |
| 191.0 | 3 - 35 |
| 192.0 | 4 - 38 |
| 193.0 | 5 - 40 |
| 194.0 | 6 - 40 |

The critical flow prover with a 1/16 inch plate was then opened to atmosphere and pressures and times were again recorded, as shown below. The temperature of the flowing gas was 44° F., the gas gravity was 0.65, and the choke constant, F, for the flow prover was 0.06569.

TABLE II

| PRESSURE (psig) | TIME (min.-sec.) |
|---|---|
| 194.3 | 0 - 0 |
| 194.4 | 0 - 34 |
| 194.5 | 1 - 02 |
| 194.6 | 2 - 25 |
| 194.8 | 6 - 25 |
| 195.0 | 8 - 27 |
| 195.2 | 11 - 56 |
| 195.4 | 12 - 20 |
| 195.6 | 14 - 36 |
| 195.8 | 16 - 36 |
| 196.0 | 17 - 40 |

The flow was stopped by closing the off-side casing valve, the flow prover was removed, and the on-side casing valve was reopened to return the well to normal operation. After completion of the test, the fluid level was 1,984 feet, as measured with a sonic instrument.

CALCULATIONS

Figure 2:
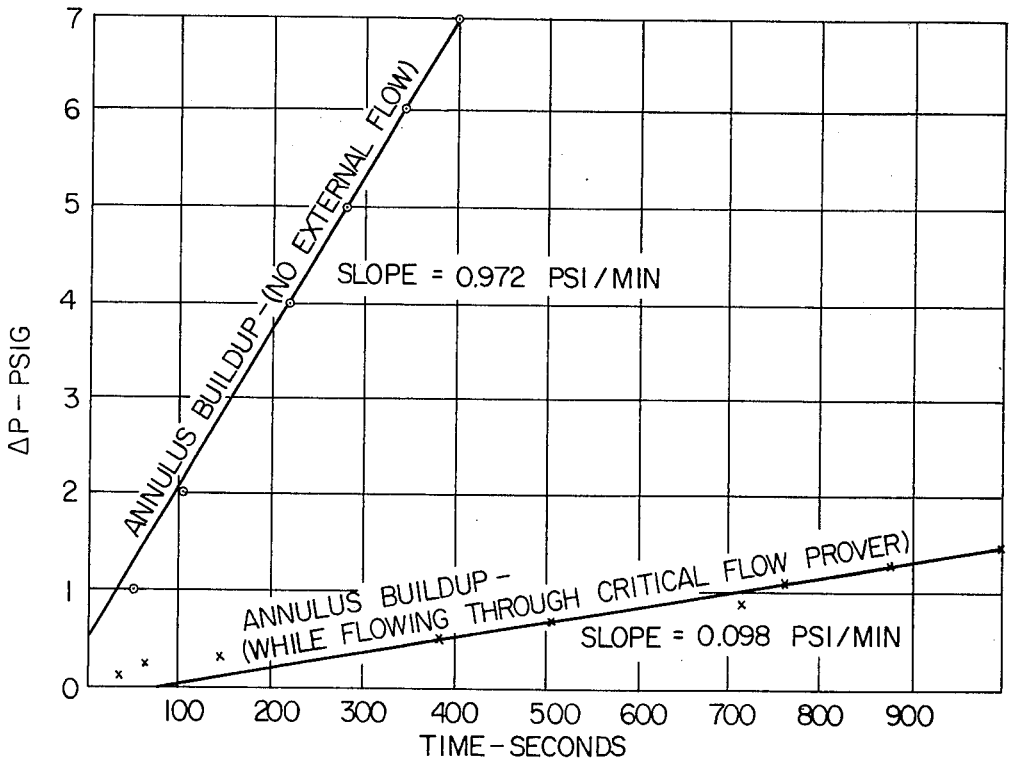
FIG. 2 is a pressure-time graph illustrating data gathered and used in accordance with one aspect of the invention.

FIG. 2 shows the pressure build-up data for the test described above. The initial rate of pressure build-up was 0.972 psi/min., and the build-up when gas was vented through the prover was 0.098 psi/min. The gas compressibility factor at 196 psig was 0.955.

(a) Gas Rate Through Prover, $q_2$.

Using the mean pressure of 195 psig converted to absolute pressure, the gas rate through the critical flow prover with a 1/16 inch orifice plate was calculated from equation (9) as follows:

$$q_2 = pF\sqrt{(520/GTz)} = 209.65 \times 0.06569 \times \sqrt{(520/0.65 \times 504 \times 0.955)} = 17.78 \text{ Mscf/D.} \quad (9)$$

(b) Annular Gas Volume ($v$)

The annular gas volume follows from the flow rate using equation (8).

$$V = q_2Tz/286((dp/dt)_1 - (dp/dt)_2)$$

Using a gas compressiblity of 0.968 gives $$V = \frac{17.78 \times 520 \times 0.968}{286 \times (0.972 - 0.98)}$$

$$= 35.80 \text{ bbls.}$$

(c) "Gas-Free" Fluid Level (D)

The fluid level is calculated by dividing the annular gas volume by the annular capacity:

D(ft) = V(bbls)/Capacity(bbls/ft) = (35.80/0.0158) = 2266 ft (which is comparable to the acoustically measured level of 1,984 ft.)

(d) Annular Gas Rate $q_1$

Bottom-hole pressure calculations do not require knowledge of the annular flow rate, but it is useful to know this rate for the determination of downhole gas separation and for calculating bottom-hole pump performance. The flow rate can be derived from equation (6) using the annular gas volume previously determined:

$$q_1 = (286\ V(dp/dt)_1)Tz$$

$$\frac{286 \times 35.8 \times 0.972}{520 \times 0.968}$$

$$= 19.15\ Mscf/D.$$

EXAMPLE 2

Figure 3:
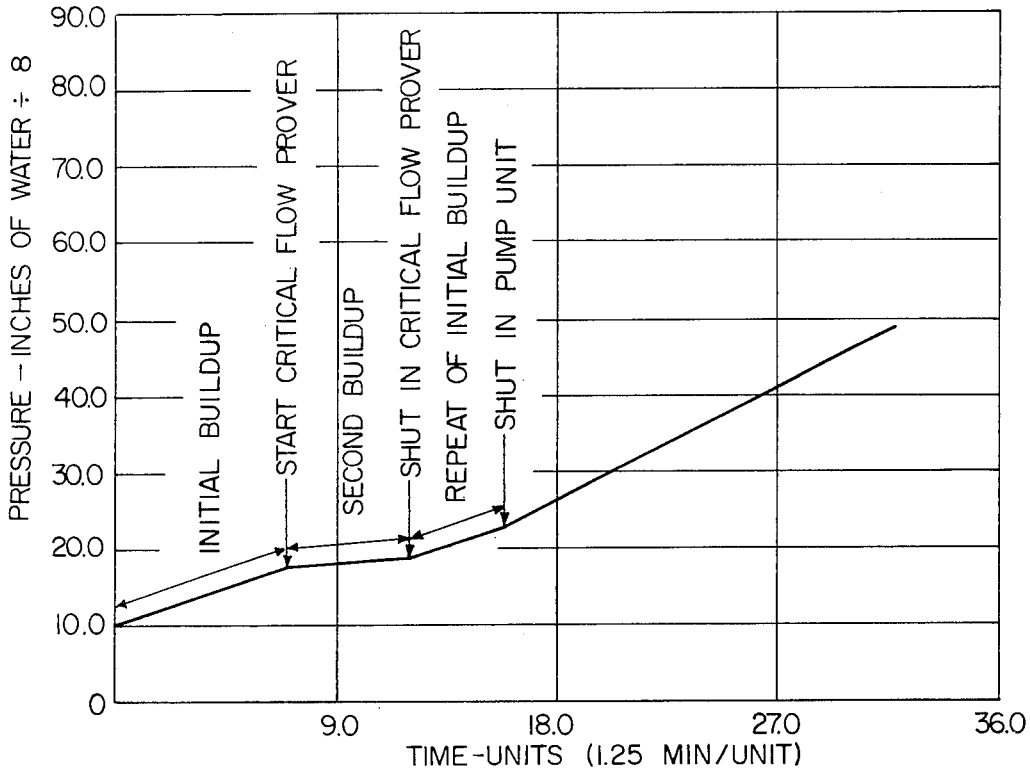
FIG. 3 is a pressure-time graph illustrating use of a further embodiment of the invention.

Well No. 2, equipped with a 7 inch production and a 2⅞ inch tubing string, was also treated by the indirect method. This well had a nitrogen tube attached to the pump seating nipple. During the test, the surface pressure remained constant at 355 psig or 413 psig at the pump seating nipple, which was landed at 4,515 ft. with reference to the casing flange. The pressures were recorded on a modified orifice meter so that a continuous record was obtained. FIG. 3 is a plot of the change in surface pressure with time. This plot gives an initial slope of 0.25092 and a drawdown slope of 0.03698 psi/-min. The casing pressure was 145 psig during the flow period and the flowing temperature was 35° F.

The calculations for this test are as follows:

(a) Gas Rate Through Prover $q_2$ $$q_2 = pF\sqrt{(520/GTz)}$$

$$= (145 + 14.65) \times 0.06569\sqrt{(520/0.65 \times 495 \times 0.97)}$$

$$= 13.54 \text{ Mscf/D.}$$

-continued (b) Annular Gas Volume (V)

$$V = q_2Tz/286((dp/dt)_1 - (dp/dt)_2)$$

$$\frac{13.54 \times 540 \times 0.97}{286 \times (0.25092 - 0.3698)}$$

$$= 115.9 \text{ bbls.}$$

(c) Fluid Level (D)

D(ft) = V(bbls)/Capacity(bbls/ft)

$$= \frac{115.9}{0.0302}$$

= 3,838 ft (sonic 3,400 ft).

(d) Bottom-Hole Pressure $p_b$ (1) Gas pressure at the top of the oil column:

$$p_b = p_s e^{GL/53.34Tz}$$

$$= 145e^{(0.65 \times 3838/53.34 \times 540 \times 0.97)}$$

= 159 psig (2) Average liquid pressure:

(For 37° API oil the pressure gradient in the oil is assumed to be 0.34 psi/ft).

$$p_{av} = \frac{159 + (4515 - 3838) \times 0.34}{2}$$

= 195 psig.

(3) Pressure gradient:

The charts gave as the pressure gradient in the oil 0.33 psi/ft for T = 80° F.

(4) Bottom-hole pressure:

$$p_b = 159 + (4515 - 3838) \times 0.33$$

= 382 psig (this compares to 412 psig as read from the nitrogen tube).

(5) Annular gas rate $q_1$:

$$q_1 = 286\ V(dp/dt)_1/Tz$$

$$= \frac{286 \times 115.9 \times 0.25092}{540 \times 0.97}$$

= 15.9 Mscf/D.

The foregoing methods can then be extended to determine the amount of fluid influx and the pump rate. The gas-free liquid level test determined the volume of gas contained in the annulus. Knowing the volume of gas enables one to determine the rate of fluid influx into the annular volume when the pumping unit is de-energized and the increase in surface pressure is recorded. By the same token, it is possible to determine the pumping rate when the pump is turned on and when the decrease in surface pressure as a function of time is noted.

Figure 4:
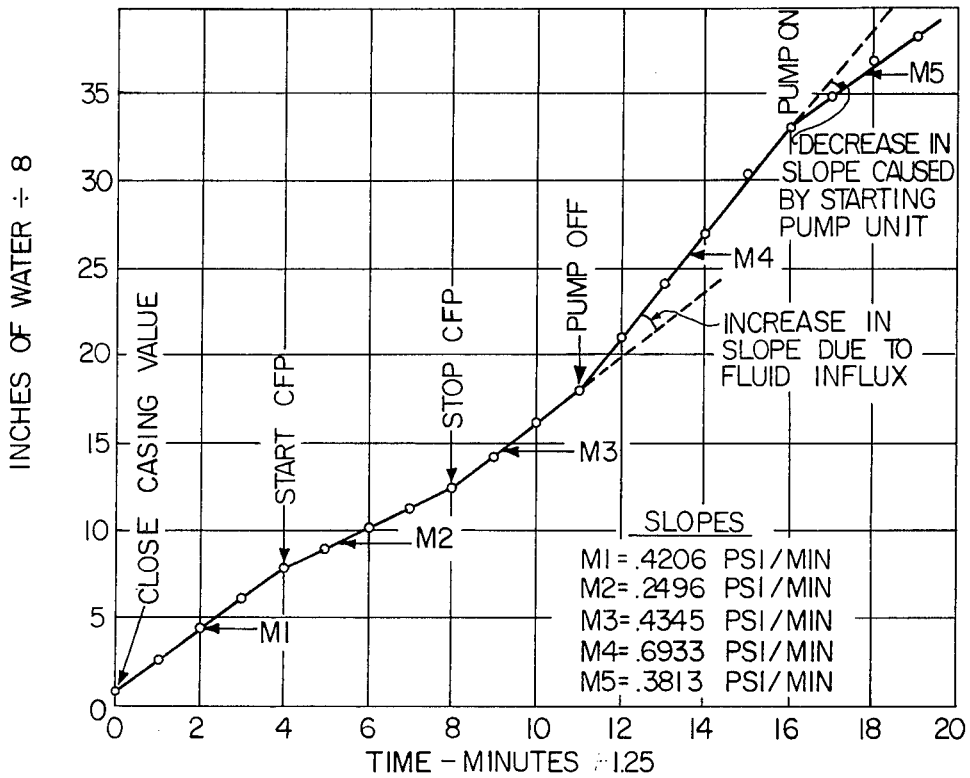
FIG. 4 is a pressure-time graph illustrating use of yet another embodiment of the invention.

Referring now to FIG. 4, when the flow through the critical flow prover is shut off, the pressure continues to rise due to the influence of the gas being liberated from the oil. The slope of this build-up is designated, in FIG. 4, as M3. If the pumping unit is then deactivated, the rate of surface pressure build-up increases due to the addition of liquid and gas production which formerly flowed through the pump. If it is then considered that all of the increase is attributable to liquid only, the liquid rate can be determined from the formula:

$$dv/dt = (V/p)(dp/dt) \quad (10)$$

Using the slopes from FIG. 4, and assuming for purposes of example that the annular volume determined from the gas-free liquid level test described above was 70 barrels, then the influx rate in reservoir barrels per day can be calculated from equation (10). In this case, the average annular pressure was determined to be 200 Psia. Substituting these figures into equation (10), $$dv/dt = (700/200)\,(0.6933 - 0.4345) = 0.09 \text{ bpm}$$

Multiplying this flow rate per minute by the number of minutes per day, it will be seen that the daily rate can be calculated as $0.09 \times 1440 = 130.4$ bpd.

In this test, the actual production rate of oil only was reported as 125 bpd. Thus, it will be seen that some of the pressure increase was due to gas. The gas rate which was flowing up the tubing can be calculated from the following equation:

$$q_t = (286\ V/Tz)(dp/dt) + (286/Tz)\,p\,(dv/dt) = (286)(70)(0.6933 - 0.4345)/(520)(0.9) + (286)(200)(-125)/(520)(0.9)(1440) = 11.07 - 10.61 = 0.46 \text{ Mscf/D.} \quad (11)$$

The rate at which the pump was pumping fluid can also be determined from equation (10) if we assume that the volume and pressure did not change significantly. Thus, $$dv/dt = (V/p)(dp/dt) = (70/200)(0.6933 - 0.3813) = 0.109 \text{ bpm por 157 bpd}$$

In this example, the rate of influx was calculated at 130.4 reservoir barrels per day and the pumping rate was calculated to be 157 reservoir barrels per day (both mixed oil and gas). Since the pump is pumping at a higher rate than the fluid is coming in, one would expect that the fluid level should be at or very near the pump. This condition was confirmed by the fluid level which was determined using both the acoustic techniques and the gas-free liquid level technique.

Thus, under ideal conditions, this method of analysis can determine the efficiency of the pumping equipment simply and directly.

INJECTION METHOD

Under some conditions it may not be desirable to vent gas through the prover plate to make the measurements as described above. For example, if venting might release "sour gas", i.e. hydrogen sulfide ($H_2S$) into the atmosphere, the venting technique would be unsafe and therefore unacceptable.

The same results can be obtained using a technique which might be viewed as a "reverse" of that discussed above wherein a gas, such as nitrogen, is injected under pressure into the well through the prover plate. The injection technique has the additional advantage that the injected gas can be known, single constituent, gas having a known specific gravity.

The injection system is especially useful in a drill stem testing, a technique which is used with a new well wherein an "empty" tubing string (containing only air) is in the well and has a valve at or near the bottom. When the valve is first opened, an unknown substance enters, and it is desirable to conduct tests to determine the nature and characteristics of the entering substance.

In this case, gas under pressure is injected through the prover plate with measurements of time and pressure being periodically taken, as previously described. Near atmospheric pressure, the Z factor is near unity. Thus, the flow or injection rate and the gas volume can be readily calculated from Equation 6.

It has also been found that with either the venting or injection methods, the fluid level can be obtained using basic PVT relationships, it being necessary then to know (or measure) the total quantity of gas vented or injected rather than employing flow rate.

For example, using the injection method, if gas is being injected at a rate of 10 Mcf/day into a drill pipe of 30 bbls. capacity and the measured pressure change is 1.0 psi/minute, and if T = 520° R and Z = 1, then the gas volume of the pipe is $$V = (q_{in}TZ)/(286\ dp/dt) = (10 \times 520 \times 1)/286 \times 1) = 18.18 \text{ bbls.}$$

Since the original gas volume was 30 bbls., then the amount of liquid present in the pipe is $$30 - 18.18 = 11.82 \text{ bbls.}$$

If one were to use the basic PVT relationships to determine the volume of liquid from the total amount of injected gas, the calculations would be as follows. Assume that gas is injected into the well as a rate of 10 Mcf/d for five minutes, then 34.72 cubic feet of gas is injected. If the starting pressure is 14.65 psia and that pressure increases by 5 lb., with $T_1 = T_2 = 60°$ F., then the number of standard cubic feet of gas in the well at the end of the test can be calculated as follows:

$$V_1 = P_2V_2T_1Z_1/P_1T_2Z_2 = (14.65 \times V_2 \times 5.61 \times 520 \times 1)/(14.65 \times 520 \times 1) = 5.61\ V_2 Scf$$

If 34.72 *Scf* of gas was injected, the total number of cubic feet in the tubing string would be $5.61V_2 + 34.72$ at a pressure of 19.65 psia.

Using PVT analysis, $$(P_1V_1)/T_1Z_1) = (P_2V_2)/(T_2Z_2)$$

$$14.64(5.61\ V_2 + 34.72)/(520 \times 1) = (19.65\ V_2 \times 5.61)/(520 \times 1)\ 5.61\ V_2 + 34.72 = 7.52V_2$$

$$V_2 = 18.18 \text{ bbls.}$$

which will be recognized as the same solution obtained using the differential form.

For a discussion of this and related techniques, including additional background material, reference is made to paper No. SPE 6024, by the present inventor, scheduled to appear in Society of Petroleum Engineers Journal, issue of Dec., 1977, as presented in New Orleans in Oct., 1976, which publication is incorporated herein by reference.

While certain advantageous embodiments have been chosen to illustrate the invention, it will be understood by those skilled in the art that varius changes and modifications can be made therein without departing from the scope of the invention as defined in the appended claims.

What is claimed is:

1. A method of determining the volume of gas in a well annulus below the wellhead comprising the steps of:

measuring the rate of gas flow in the annulus while a path for emerging gas is open through the wellhead;

closing the wellhead gas path and measuring the change of pressure in the annulus over a predetermined interval of time to determine the pressure change rate; and calculating the volume of gas as a function of the ratio of said gas flow measurement to said pressure change rate.

2. A method of determining the volume of gas in a well annulus below the wellhead comprising the steps of:

measuring the rate of gas flow in the annulus while a path for emerging gas is open through the wellhead;

closing the wellhead gas path and measuring the change of pressure in the annulus over a predetermined interval of time to determine the pressure change rate; and calculating the volume of gas as a function of the ratio of said gas flow measurement to said pressure change rate in accordance with the relationship $$V = Kq_1/(dp/dt)$$

where $K$ is a constant, $q_1$ is the measured gas flow rate and $dp/dt$ is the pressure change rate.

3. A method according to claim 2 wherein $$K = (Tz/286)$$

where $T$ is temperature, °R and $z$ is the gas deviation factor.

4. A method of determining the volume of gas in a well annulus below the wellhead comprising the steps of:

measuring the rate of gas flow in the annulus while a path for emerging gas is open through the wellhead;

closing the wellhead gas path and measuring the change of pressure in the annulus over a predetermined interval of time to determine the pressure change rate; and calculating the volume of gas as a function of the ratio of said gas flow measurement to said pressure change rate in accordance with the relationship $$V = Kq_1(dp/dt) - pc$$

where $k$ is a constant, $q_1$ is the measured gas flow rate, $dp/dt$ is the pressure change rate, $p$ is the pressure (psia) and $c$ is the product of the liquid gradient and the annular capacity.

5. a method of determining the volume of gas in a well annulus below the wellhead comprising the steps of:

providing on said wellhead a vent plate having a vent orifice of predetermined calibrated size and a valve to selectively open and close the gas path between the well and the vent plate;

closing said valve and measuring and recording the change in pressure at the wellhead and the interval of time over which said change took place;

opening said valve to permit venting through said orifice to the atmosphere for a predetermined interval of time;

repeatedly measuring and recording gas pressure at the wellhead and the times of said measurements during said interval; and calculating from said recorded measurements the gas flow rate through said orifice, gas volume V in said annulus, and the annular gas rate.

6. A method of determining the volume of gas in a well annulus below the wellhead comprising the steps of:

providing on said wellhead a vent plate having a vent orifice of predetermined calibrated size and a valve to selectively open and close the gas path between the well and the vent plate;

closing said valve and measuring and recording the change in pressure at the wellhead and the interval of time over which said change took place;

opening said valve to permit venting through said orifice to the atmosphere for a predetermined interval of time;

repeatedly measuring and recoring gas pressures at the wellhead and the times of said measurements during said interval; and calculating from said recorded measurements the gas flow rate through said orifice, gas volume V in said annulus, and the annular gas rate, and wherein said gas flow rate through said orifice is identified as $q_2$ and is calculated in accordance with the relationship $$q_2 = pFK_1$$

wherein $p$ is the absolute pressure at the wellhead, $F$ is the choke constant of the orifice and $K_1$ is a constant determined from gas characteristics.

7. A method according to claim 6 wherein said gas volume V is calculated in accordance with the relationship $$V = q_2K_2/((dp/dt)_1 - (dp/dt)_2)$$

wherein $K_2$ is a constant determined from gas characteristics, $(dp/dt)_1$ is the rate of change of gas pressure determined with the valve closed and $(dp/dt)_2$ is the rate of change in the gas pressure with said valve open.

8. A method according to claim 7 wherein $$K_1 = \sqrt{(520/GTz)}$$

and wherein $$K_2 = Tz/286$$

where $G$ is the gas specific gravity, $T$ is temperature, °R, and $Z$ is gas deviation factor.

9. A method according to claim 7 and further comprising determining the pmping rate in accordance with the relationship $$dv/dt = -(v/p)dp/dt$$

10. A method according to claim 6 wherein said gas volume V is calculated in accordance with the relationship $$V = q_2K_2/((dp/dt)_1 - (dp/dt)_2) - pc$$

wherein $K_2$ is a constant determined from gas characteristics, $(dp/dt)_1$ is the rate of change in gas pressure determined with the valve closed, $(dp/dt)_2$ is the rate of change in the gas pressure with the valve open, $p$ is the pressure (psia) and $c$ is the product of the liquid gradient and the annular capacity.

11. A method according to claim 10 and further comprising determining the annular rate of fluid influx when the pump is de-energized in accordance with the relationship $$dV/dt = -(V/p)(dp/dt)$$

12. A method according to claim 11 and further comprising determining the rate of gas that was associated with the oil as it passed through the pump in accordance with the relationship $$q_t = (286V/T_z)dp/dt + (286/T_z)pdV/dt$$

13. A method according to claim 10 and further comprising determining the pumping rate in accordance with the relationship $$dv/dt = -(v/p)dp/dt.$$

14. A method of determining the volume of gas in a well annulus below the wellhead comprising the steps of:

providing on said wellhead a critical flow prover comprising a vent plate having a vent orifice of predetermined calibrated size and a valve to selectively open and close the gas path between the well and the vent plate;

closing said valve and measuring and recording the change in pressure at the wellhead and the interval of time over which said change took place;

opening said valve to permit venting through said orifice to the atmosphere for a predetermined interval of time;

repeatedly measuring and recording gas pressures at the wellhead and the times of said measurements during said interval; and calculating from said recorded measurements the gas flow rate through said orifice, gas volume in said annulus, and the annular gas rate, and wherein the annular gas rate is determined from the relationship $$q_1 = \frac{q_2\,(dp/dt_1)}{dp/dt_1 - (dp/dt_2)}$$

where $q_2$ = the flow rate passing through the critical flow prover.

15. A method of determining the volume of gas in a well below the wellhead comprising the steps of:

providing on said wellhead a metering device and a valve to selectively open and close the gas path between the well and the metering device;

closing said valve and measuring and recording the change in pressure at the wellhead and the interval of time over which said change took place;

connecting a source of gas under pressure to said metering device;

opening said valve to permit injection of said gas through said metering device to the well annulus for a predetermined interval of time;

repeatedly measuring and recording gas pressure at the wellhead and the times of said measurements during said interval; and calculating from said recorded measurements the gas flow rate through said metering device and the gas volume V.

* * * * *